US008555771B2

(12) United States Patent
Kude

(10) Patent No.: US 8,555,771 B2
(45) Date of Patent: Oct. 15, 2013

(54) APPARATUS FOR SYNTHETIC WEAPON STABILIZATION AND FIRING

(75) Inventor: William B. Kude, Plymouth, MN (US)

(73) Assignee: Alliant Techsystems Inc., Arlington, VA (US)

( * ) Notice: Subject to any disclaimer, the term of this patent is extended or adjusted under 35 U.S.C. 154(b) by 0 days.

(21) Appl. No.: 13/420,441

(22) Filed: Mar. 14, 2012

(65) Prior Publication Data

US 2012/0286041 A1 Nov. 15, 2012

Related U.S. Application Data

(62) Division of application No. 12/406,778, filed on Mar. 18, 2009, now Pat. No. 8,141,473.

(51) Int. Cl.
*F41G 3/12* (2006.01)

(52) U.S. Cl.
USPC ..... 89/41.03; 89/41.01; 89/41.02; 89/27.11; 89/28.1; 89/28.2

(58) Field of Classification Search
USPC ..... 89/41.01–41.03
See application file for complete search history.

(56) References Cited

U.S. PATENT DOCUMENTS

| | | | | | |
|---|---|---|---|---|---|
| 3,644,043 | A * | 2/1972 | Jones et al. | 356/5.08 |
| 3,949,508 | A | 4/1976 | Elkas | |
| 4,203,348 | A | 5/1980 | Sokolovsky | |
| 4,383,474 | A * | 5/1983 | Paurus et al. | 89/41.03 |
| 4,622,554 | A * | 11/1986 | Gellekink et al. | 342/67 |
| 4,777,352 | A * | 10/1988 | Moore | 235/404 |
| 4,908,970 | A | 3/1990 | Bell | |
| 4,926,574 | A | 5/1990 | Rieger | |
| 4,949,089 | A * | 8/1990 | Ruszkowski, Jr. | 342/52 |
| 5,105,570 | A | 4/1992 | Lishness et al. | |
| 5,520,085 | A | 5/1996 | Ng et al. | |
| 5,548,914 | A | 8/1996 | Anderson | |
| 5,692,062 | A | 11/1997 | Lareau et al. | |
| 5,697,178 | A | 12/1997 | Haskell | |
| 5,798,786 | A | 8/1998 | Lareau et al. | |
| 5,949,015 | A | 9/1999 | Smith et al. | |
| 5,966,859 | A * | 10/1999 | Samuels | 42/70.11 |
| 6,085,629 | A * | 7/2000 | Thiesen et al. | 89/6.5 |
| 6,260,466 | B1 * | 7/2001 | Humphreys | 89/41.06 |
| 6,392,632 | B1 | 5/2002 | Lee | |
| 6,412,206 | B1 | 7/2002 | Strayer | |
| 6,480,629 | B1 | 11/2002 | Bakhmutsky | |
| 6,497,171 | B2 | 12/2002 | Gerber et al. | |
| 6,658,207 | B1 * | 12/2003 | Partynski et al. | 396/7 |
| 6,966,138 | B1 | 11/2005 | Deckard | |
| 7,110,101 | B2 | 9/2006 | Schneider | |
| 7,181,880 | B2 | 2/2007 | Keeney | |
| 7,210,392 | B2 * | 5/2007 | Greene et | 89/41.03 |
| 7,212,230 | B2 | 5/2007 | Stavely | |
| 7,254,279 | B2 | 8/2007 | Chen | |
| 7,305,179 | B2 | 12/2007 | Ogawa | |
| 7,307,653 | B2 | 12/2007 | Dutta | |
| 7,559,269 | B2 * | 7/2009 | Rudakevych et al. | 89/27.11 |
| 7,886,648 | B2 * | 2/2011 | Williams et al. | 89/1.11 |
| 2004/0050240 | A1 * | 3/2004 | Greene et al. | 89/41.06 |
| 2005/0021282 | A1 * | 1/2005 | Sammut et al. | 702/150 |
| 2005/0263000 | A1 * | 12/2005 | Hill | 89/136 |
| 2006/0005447 | A1 * | 1/2006 | Lenner et al. | 42/111 |
| 2007/0040805 | A1 | 2/2007 | Mellot | |
| 2007/0041616 | A1 | 2/2007 | Lee et al. | |
| 2007/0127574 | A1 | 6/2007 | Yao et al. | |
| 2007/0188617 | A1 | 8/2007 | Stavely | |
| 2007/0212041 | A1 | 9/2007 | Kosako et al. | |
| 2007/0230931 | A1 | 10/2007 | Nomura et al. | |
| 2007/0242936 | A1 * | 10/2007 | Chujo et al. | 396/55 |
| 2007/0242937 | A1 | 10/2007 | Sano et al. | |
| 2007/0248167 | A1 | 10/2007 | Park et al. | |
| 2007/0291127 | A1 | 12/2007 | Prietoa et al. | |
| 2008/0121097 | A1 * | 5/2008 | Rudakevych et al. | 89/28.05 |
| 2009/0020002 | A1 * | 1/2009 | Williams et al. | 89/41.03 |

FOREIGN PATENT DOCUMENTS

EP 0728290 B1 2/2002

* cited by examiner

*Primary Examiner* — Samir Abdosh
(74) *Attorney, Agent, or Firm* — TraskBritt

(57) ABSTRACT

In methods and apparatuses, a weapon includes a trigger module for sensing trigger input from a shooter and generating a trigger signal, and a firing module for controlling firing of a projectile responsive to a fire control signal. The weapon also includes an image sensor configured for mounting on the weapon and sensing a series of images over a time period of interest while the trigger signal is in a motion-estimation state. A controller is configured for determining when to fire the weapon by receiving the images from the image sensor and generating a motion-estimation history over the time period of interest responsive to changes in the images. The controller is also configured for determining a centroid of the motion-estimation history and asserting the fire control signal when the trigger signal is in a fire-enable state and a current image is within an offset threshold from the centroid.

19 Claims, 6 Drawing Sheets

APPARATUS FOR SYNTHETIC WEAPON STABILIZATION AND FIRING

CROSS-REFERENCE TO RELATED APPLICATION

This application is a divisional of U.S. patent application Ser. No. 12/406,778, filed Mar. 18, 2009, which issued as U.S. Pat. No. 8,141,473, on Mar. 27, 2012, the disclosure of which is hereby incorporated herein by this reference in its entirety.

TECHNICAL FIELD

Embodiments of the present invention relate generally to aiming and firing weapons. More specifically, embodiments of the present invention relate to increasing accuracy in aiming and firing of weapons.

BACKGROUND

When making a shot with a projectile weapon, such as a firearm, the job of a marksman is to hold the weapon still and squeeze the trigger to release the sear without disturbing the weapon's stability. It is virtually impossible to hold the weapon perfectly still and accurately sighted on a target and many different variables can affect the accuracy of the shot. Sighting problems can be improved with optical aids, such as telescopic sights, which can nearly eliminate sight alignment errors. However, keeping the projectile weapon steadily pointed at a target can still be difficult.

To increase accuracy, many weapons may include a bipod or mounting bracket positioned on a stable platform to assist in stabilizing the weapon while still allowing freedom of movement for aiming. However, even with these sorts of stabilization assistance, a marksman will find it difficult to keep the weapon aimed at exactly the same spot. In addition, trigger control is a difficult part of accurately firing a weapon. Inaccuracies due to trigger control generally can be considered from two different sources that are attributable to movement by the marksman prior to release of the projectile. Flinching occurs when the marksman makes small movements in anticipation of the weapon firing. The flinching may be attributable to anticipation of the noise, recoil, or combination thereof that occurs when firing a projectile weapon. The small movements of the marksman translate to small movements of the weapon, which can translate to significant movements away from the intended target before the projectile is released. Jerking is caused when the marksman pulls the trigger or other release mechanism in a manner that causes movement of a projectile weapon. Again, small movements of the weapon can translate into large movements away from the intended target.

Weapon steadiness and trigger control require significant training in order to achieve excellent marksmanship. This is particularly true at long ranges. As examples of how very small movements of the weapon translate into significant movements away from the target; a 1 angular mil movement of the weapon, which is only a 0.012-inch movement with a 12-inch sight radius, equates to a 1-meter miss at 1000 meters, or a 1-foot miss at 1000 feet (333 yards).

Weapon stabilization mechanisms have been proposed. One example is naval and air gunfire where stabilization mechanisms for a gun may be mounted on a ship or aircraft. However, these stabilization systems usually include complex sensors, servomechanisms, and feedback to compensate for the motion of the ship or aircraft.

There is a need for apparatuses and methods to provide simpler, more economical, and more accurate aiming capabilities for a variety of weapons and in a variety of shooting environments.

BRIEF SUMMARY OF THE INVENTION

Embodiments of the present invention comprise apparatuses and methods to provide more accurate aiming capabilities for a variety of weapons and in a variety of shooting environments by providing a synthetic stabilization of the weapon.

An embodiment of the invention comprises a method for determining a firing time for a weapon. The method includes tracking motion of the weapon by analyzing relative motion of a barrel of the weapon while directed toward a target. The method also includes determining a range of motion of the weapon over a time period of interest responsive to the tracking and generating a fire control signal when a direction of the weapon is within an offset threshold below the range of motion of the weapon.

Another embodiment of the invention also comprises a method for determining a firing time for a weapon. The method includes sensing a plurality of images over a time period of interest with an image sensor fixedly coupled to the weapon while the weapon is pointed at a target. The method also includes processing the plurality of images to determine a motion-estimation history over the time period of interest responsive to changes in the plurality of images. A centroid of the motion-estimation history is determined and a fire control signal is generated when a current image position is within an offset threshold from the centroid.

Another embodiment of the invention comprises an apparatus for determining when to fire a weapon. The apparatus includes a trigger interface, a fire-time synthesizer, and a fire actuator. The trigger interface is configured for indicating a fire-enable state. The fire-time synthesizer is configured for asserting a fire control signal a substantially random time delay after the fire-enable state and the fire actuator is configured for discharging the weapon responsive to the fire control signal.

Yet another embodiment of the invention is an apparatus for determining when to fire a weapon, which includes an image sensor, a trigger interface, a memory, and a processor. The image sensor is configured for mounting on the weapon and sensing a plurality of images over a time period of interest while the weapon is pointed at a target. The trigger interface is configured for indicating a motion-estimation state and a fire-enable state. The memory is configured for storing computer instructions. The processor is coupled to the image sensor and the memory and configured for executing the computer instructions to receive the plurality of images from the image sensor and determine a motion-estimation history over the time period of interest from changes in the plurality of images. The processor also executes computer instruction to determine a centroid of the motion-estimation history and generate a fire control signal when a current image is within an offset threshold from the centroid.

Yet another embodiment of the invention is a weapon that includes a gun barrel for directing a projectile, a trigger module for sensing trigger input from a shooter and generating a trigger signal, and a fire actuator for discharging the weapon responsive to a fire control signal. The weapon also includes a fire-time synthesizer, which includes an image sensor configured for mounting on the weapon and sensing a plurality of images over a time period of interest while the trigger signal is in a motion-estimation state. The fire-time synthesizer also includes a controller configured for determining when to fire the weapon by receiving the plurality of images from the image sensor and generating a motion-estimation history over the time period of interest responsive to changes in the plurality of images. The controller is also configured for determining a centroid of the motion-estimation history and asserting the fire control signal when the trigger signal is in a fire-enable state and a current image is within an offset threshold from the centroid.

DETAILED DESCRIPTION OF THE INVENTION

Embodiments of the present invention comprise apparatuses and methods to provide more accurate aiming capabilities for a variety of weapons and in a variety of shooting environments by providing a synthetic stabilization of the weapon. The synthetic stabilization may be based on tracking past movement, anticipating future movement, generating a firing time that is somewhat unpredicted by the marksman, or combinations thereof.

In the following detailed description, reference is made to the accompanying drawings which form a part hereof, and in which is shown by way of illustration specific embodiments in which the invention may be practiced. These embodiments are described in sufficient detail to enable those of ordinary skill in the art to practice the invention. It should be understood, however, that the detailed description and the specific examples, while indicating examples of embodiments of the invention, are given by way of illustration only and not by way of limitation. From this disclosure, various substitutions, modifications, additions, rearrangements, or combinations thereof within the scope of the present invention may be made and will become apparent to those skilled in the art.

In this description, circuits, logic, and functions may be shown in block diagram form in order not to obscure the present invention in unnecessary detail. Additionally, block designations and partitioning of functions between various blocks are examples of specific implementations. It will be readily apparent to one of ordinary skill in the art that the present invention may be practiced by numerous other partitioning solutions.

In this description, some drawings may illustrate signals as a single signal for clarity of presentation and description. Persons of ordinary skill in the art will understand that the signal may represent a bus of signals, wherein the bus may have a variety of bit widths and the present invention may be implemented on any number of data signals including a single data signal.

Figure 1:
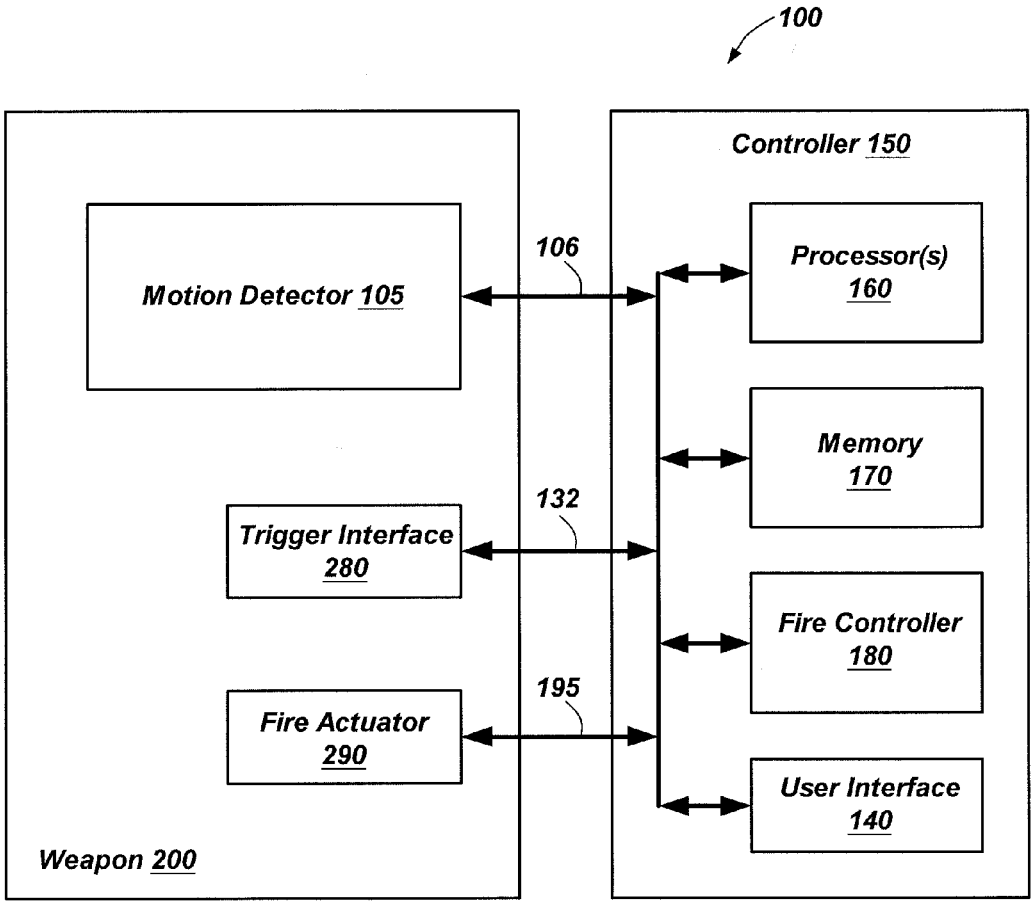
FIG. 1 is a simplified block diagram illustrating a fire-time synthesizer for providing synthetic weapon stabilization according to an embodiment of the invention.

FIG. 1 is a simplified block diagram illustrating a fire-time synthesizer 100 for providing synthetic weapon stabilization. The fire-time synthesizer 100 includes a controller 150 and a motion detector 105, which communicates motion information on a motion signal bus 106 to the controller 150. The fire-time synthesizer 100 also includes a trigger interface 280, which communicates a trigger signal 199 to the controller 150, and a fire actuator 290, which receives fire control signals 196 from the controller 150. The controller 150 may also include a user-interface module 140. The user-interface module 140 may be used for user-selection of variables that may be used based on the weapon that is used, the situation in which the weapon is used, the accuracy that may be desired, and other suitable variables. Many of these variables are explained in more detail below.

Figure 2:
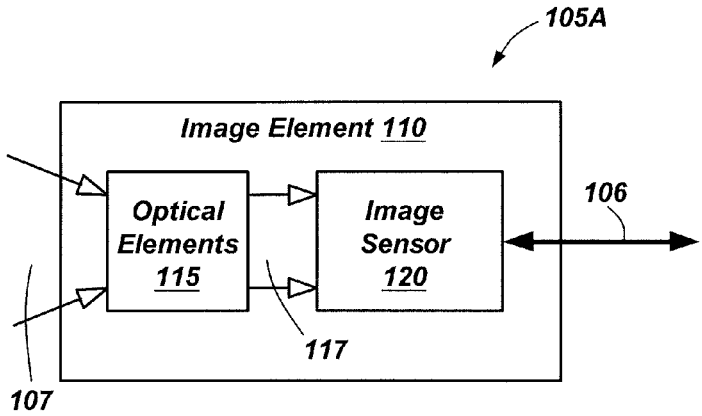
FIG. 2 is a simplified block diagram illustrating an imaging element as part of a motion detector according to an embodiment of the invention.

In some embodiments, the motion detector 105 may be configured using an imaging system 105A. The imaging system 105A includes an image element 110 for detecting and capturing images. As illustrated in FIG. 2, the image element 110 includes an image sensor 120 and may also include one or more optical elements 115 for adjusting a field of view 107 for presentation to the image sensor 120 as a sensor field of view 117. As non-limiting examples, the optical adjustments performed by the optical elements 115 may include focusing, magnifying, filtering, and combinations thereof. The image element 110 captures a history of images and sends the images to the controller 150 (FIG. 1) on the motion signal bus 106.

The image element 110 is affixed in some manner to a weapon 200 such that the image element 110 moves with the weapon 200. Some or all of the other elements for the fire-time synthesizer 100 also may be disposed on the weapon 200. As a non-limiting example, FIG. 1 illustrates the trigger interface 280 and the fire actuator 290 disposed on the weapon 200.

Figure 3:
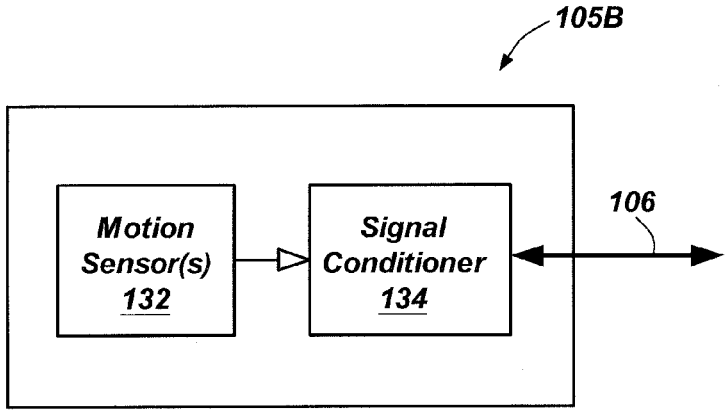
FIG. 3 is a simplified block diagram illustrating one or more analog motion sensors as part of a motion detector according to an embodiment of the invention.

In some embodiments, the motion detector 105 may be configured using an analog motion detection system 105B, as illustrated in FIG. 3. The analog motion detection system 105B is affixed in some manner to a weapon 200 such that one or more motion sensors 132 detect motion of the weapon 200, which can be translated into motion of the barrel of the weapon 200. A signal conditioner 134 may be included to modify electrical signals generated by the motion sensors 132 prior to presentation to the controller 150 (FIG. 1) on the motion signal bus 106. As non-limiting examples, signal conditioning may include filtering, digitization, and other suitable operations on the analog signals from the motion sensors 132. Alternatively, analog information from the motion sensors 132 may be coupled directly to the controller 150 where the analog signals may be digitized.

As non-limiting examples, the motion sensors 132 may be devices such as piezoelectric gyroscopes, vibrating structure gyroscopes, Micro-Electro-Mechanical Systems (MEMS) devices, accelerometers, or other suitable motion-sensing devices. As is known by those of ordinary skill in the art, if the motion is detected in the form of acceleration or velocity, a time history may be integrated to determine a velocity, or displacement, respectively. With a displacement history known, processing to synthesize a firing time may proceed as described below when discussing fire-time synthesis using the imaging system 105A, as shown in FIG. 2.

The weapon may be any weapon that requires aiming at a potential target, such as, for example, a projectile weapon or a directed-energy weapon. Some non-limiting examples of suitable projectile weapons 200 are handguns, air-guns, crossbows, shoulder fired weapons, such as an AT4, and the like. Some non-limiting examples of suitable directed-energy weapons 200 are electromagnetic energy weapons, such as lasers, and pulsed-energy weapons, such as stun guns and tasers. In addition, embodiments of the present invention can be used to provide synthetic weapon stabilization to weapons 200, including larger caliber weapons, mounted to moving platforms, such as, for example, watercraft, aircraft, tanks, and other land vehicles.

The controller 150 may also include one or more processors 160, a memory 170, and a fire controller 180. In some embodiments, the controller 150, as illustrated in FIG. 1, represents a computing system for practicing one or more embodiments of the invention. Thus, the controller 150 may be configured for executing software programs containing computing instructions for execution on the one or more processors 160, and storage in the memory 170.

As non-limiting examples, the processor 160 may be a general-purpose processor, a special-purpose processor, a microcontroller, or a digital signal processor. The memory 170 may be used to hold computing instructions, data, and other information for performing a wide variety of tasks, including performing embodiments of the present invention. By way of example, and not limitation, the memory may include one or more of Synchronous Random Access Memory (SRAM), Dynamic RAM (DRAM), Read-Only Memory (ROM), Flash memory, and the like.

Software processes for execution on the processor 160 are intended to illustrate example processes that may be performed by the systems illustrated herein. Unless specified otherwise, the order in which the process acts are described is not intended to be construed as a limitation, and acts described as occurring sequentially may occur in a different sequence, or in one or more parallel process streams. It will be appreciated by those of ordinary skill in the art that many acts and processes may occur in addition to those outlined in the flowcharts. Furthermore, the processes may be implemented in any suitable hardware, software, firmware, or combinations thereof.

When executed as firmware or software, the instructions for performing the processes may be stored on a computer-readable medium. A computer-readable medium includes, but is not limited to, magnetic and optical storage devices such as disk drives, magnetic tape, CDs (compact discs), DVDs (digital versatile discs or digital video discs), and semiconductor devices such as RAM, DRAM, ROM, EPROM, and Flash memory.

The processor 160, when executing computing instructions configured for performing the processes, constitutes structure for performing the processes. In addition, while not specifically illustrated, those of ordinary skill in the art will recognize that some portion or all of the processes described herein may be performed by hardware specifically configured for carrying out the processes, rather than by computer instructions executed on the processor 160.

In operation, the controller 150 (FIG. 1) is configured for receiving multiple sequential images from the image element 110 (FIG. 2). The controller 150 may perform motion-estimation algorithms by evaluating differences between one image and one or more subsequent images.

The motion-estimation algorithms employed in embodiments of the present invention may be relatively simple or quite complex. As a non-limiting example, relatively complex motion-estimation algorithms used in video processing, such as those practiced for Moving Pictures Expert Group (MPEG) compression, may be employed. One example of a complex motion estimation may be found in U.S. Pat. No. 6,480,629, the disclosure of which is incorporated by reference herein. In addition, the motion-estimation algorithm may be performed on the entire image or selected sections of the image. Furthermore, the motion estimation may be performed at the pixel level, block level, macro-block level, or at the level of the entire image.

Motion estimation generates motion vectors that describe the transformation from one two-dimensional image to another two-dimensional image, usually from temporally adjacent frames in a video sequence. The resulting motion vectors may relate to the whole image (global motion estimation) or to specific parts, such as rectangular blocks, macro-blocks, arbitrarily shaped patches, or even per pixel. The motion vectors may be represented by a translational model or many other models that can approximate the motion of a video sensor, such as rotation and translation. The motion vectors also may be represented in a number of coordinate systems, such as, for example, rectangular coordinate systems and polar coordinate systems.

Some non-limiting examples of motion-estimation algorithms include block matching, phase correlation, pixel-recursive algorithms, and frequency domain analysis.

As will be explained in more detail below, by keeping a history of the motion vectors from each video frame (i.e., image from the image element 110), embodiments of the present invention can determine how much deviation is occurring over time in the aiming of a weapon at a target.

Figure 4:
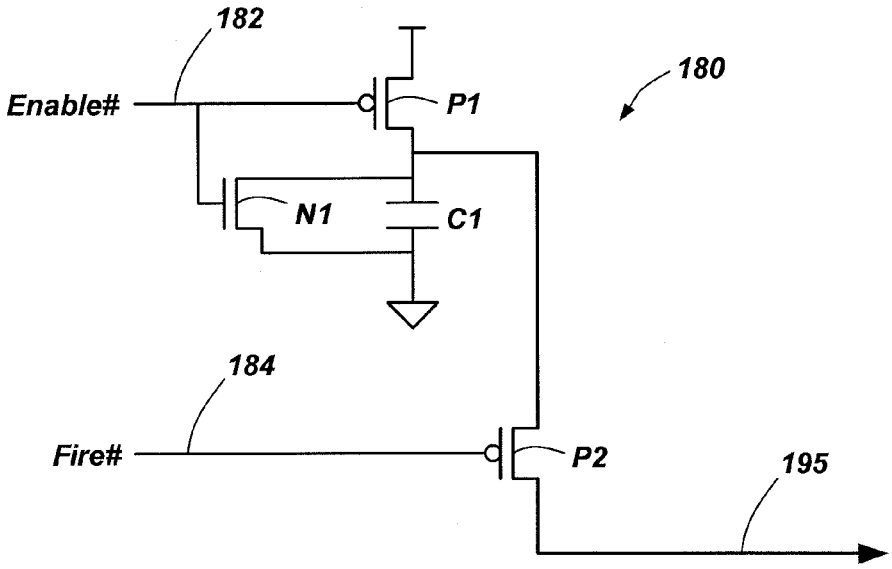
FIG. 4 is a simplified circuit diagram illustrating a fire controller according to an embodiment of the invention.

FIG. 4 is a simplified block diagram illustrating a fire controller 180 that may be used in embodiments of the invention. The fire controller 180 may be used to enhance safety and ensure that an electronic firing mechanism does not discharge the weapon when a discharge should not occur. An enable# signal 182 controls p-channel transistor P1 and n-channel transistor N1. Similarly, a fire# signal 184 controls p-channel transistor P2. In operation, when asserted (i.e., low), the enable# signal 182 turns p-channel transistor P1 on to charge capacitor C1. Once capacitor C1 is charged, if the fire# signal 184 is asserted, the charge on capacitor C1 can flow through p-channel transistor P2 to assert a fire enable signal 195, which may be a type of fire control signal 196 (FIG. 1). When the enable# signal 182 is negated (i.e., high), n-channel transistor N1 turns on and discharges capacitor C1, preventing the fire enable signal 195 from being asserted even if fire# signal 184 is asserted. As will be seen later, the enable# signal 182 may be driven by a fire-enable state and the fire# signal 184 may be driven by a fire signal from the processor 160 or an override state. While illustrated as CMOS transistors, the switching function may be accomplished by a number of different elements, such as, for example, bipolar transistors and relays. Of course, those of ordinary skill in the art will recognize that the fire controller 180 is an example of one type of fire controller. Many other fire controllers are contemplated as within the scope of the invention.

Figure 5:
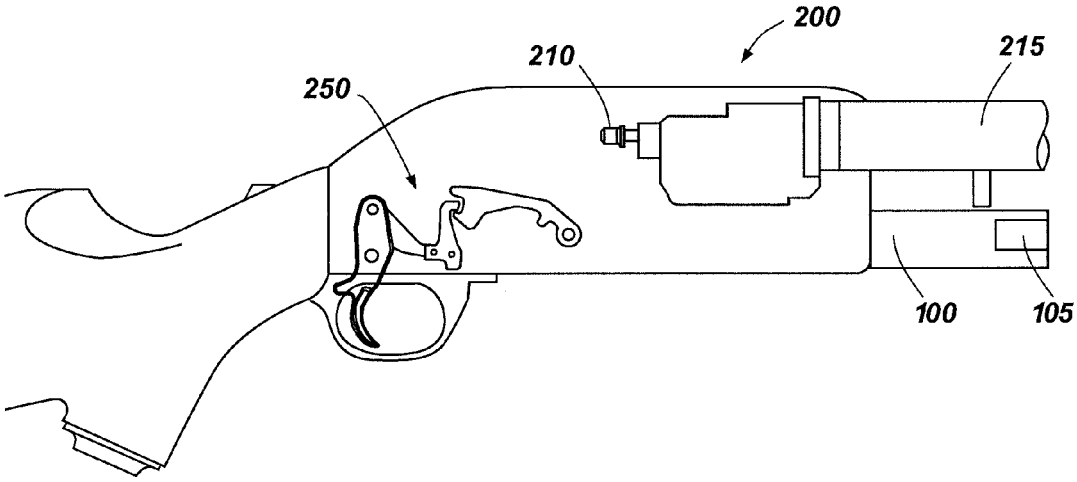
FIG. 5 is a diagram showing a cut-away view of portions of a rifle and a fire-time synthesizer attached to the rifle according to an embodiment of the invention.

FIG. 5 is a diagram showing a cut-away view of portions of a rifle 200' and a fire-time synthesizer 100 attached to the rifle 200'. The rifle 200' is used as a non-limiting example of one type of weapon 200 for which embodiments of the present invention may be used. The rifle 200' includes a trigger mechanism 250, a firing pin 210, a gun barrel 215, and the fire-time synthesizer 100. The fire-time synthesizer 100 may also include the motion detector 105. In conventional operation, a marksman operates the trigger mechanism 250 to cause a hammer to strike the firing pin 210, which strikes a primer, which ignites a propellant to launch a projectile. Of course, other weapons 200 may have different components for launching the projectile or energy beam under command from the marksman. These triggering components may be mechanical, electrical, or combinations thereof.

The fire-time synthesizer 100 may be mounted at any suitable location on the weapon 200. In addition, as is explained below, it is not necessary that the image sensor 120 be accurately pointed at the target or aligned with sighting elements. In fact, the image sensor 120 may be pointed in any direction that will capture images suitable for detection of motion of the weapon 200.

Figure 6:
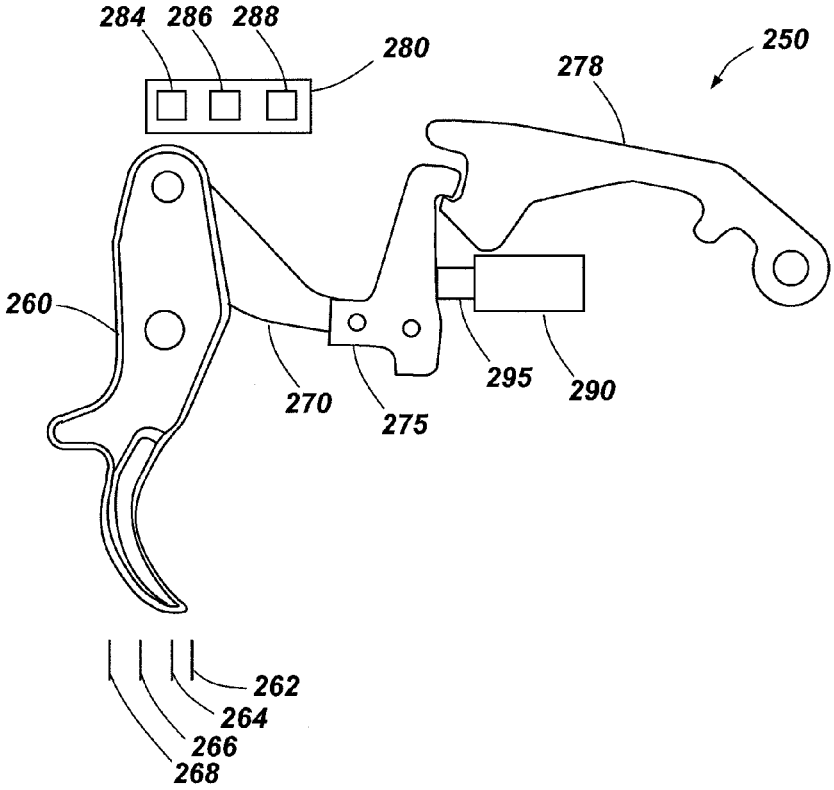
FIG. 6 illustrates portions of a trigger and firing mechanism for the rifle of FIG. 5.

FIG. 6 illustrates portions of the trigger mechanism 250 for the rifle 200' of FIG. 5. As illustrated in FIG. 6, a conventional trigger mechanism 250 is retrofitted to include elements for performing one or more embodiments of the invention. The conventional trigger mechanism 250 includes a trigger 260, a linkage 270, a sear 275, and a hammer 278. When a marksman pulls the trigger 260 far enough, the trigger 260 and linkage 270 combine to rotate the sear 275, which releases the hammer 278 to strike the firing pin 210 (FIG. 5). In embodiments of the present invention, the trigger mechanism 250 includes the trigger interface 280 and the fire actuator 290, illustrated in FIG. 1. In FIG. 6, the fire actuator 290 is in the form of a solenoid 290' with an armature 295. The solenoid 290' receives the fire control signal 196 (not shown in FIG. 6), which moves the armature 295 to release the sear 275. Thus, the fire time is under control of actuation of the solenoid 290' rather than, or in addition to, the trigger 260.

The trigger interface 280 detects different positions of the trigger 260. Designators 262, 264, 266, and 268 illustrate trigger positions. An inactive position 262 is when the trigger 260 is in its quiescent state. The marksman may pull the trigger 260 back a small amount to put the trigger 260 in a motion-estimation position 264. The marksman may pull the trigger 260 back an additional amount to put the trigger 260 in a fire-enable position 266. Finally, the marksman may pull the trigger 260 all the way back to an override position 268. The trigger interface 280 may include three different trigger sensors 284, 286, and 288 to detect the different trigger positions 264, 266, and 268. The trigger sensors 284, 286, and 288 generate one or more signals as the trigger signal 199 (FIG. 1) to the controller 150 (FIG. 1). Thus, the trigger sensors 284, 286, and 288 sense an inactive state when none of the trigger sensors 284, 286, and 288 are active, a motion-estimation state 284 corresponding to the motion-estimation position 264, a fire-enable state 286 corresponding to the fire-enable position 266, and an override state 288 corresponding to the override position 268.

In operation, the marksman pulls the trigger 260 to the motion-estimation position 264 to begin the motion-estimation process. The marksman pulls the trigger 260 to the fire-enable position 266 to enable the weapon 200 to fire at a time selected by the fire-time synthesizer 100 (FIG. 5), as is explained more fully below.

In addition, the fire-enable state 286 may include a range of pressure, displacement, or combination thereof on the trigger 260. With this range of pressure, the marksman may control the desired precision level for the fire-time synthesizer 100. Thus, as is explained more fully below, with slight pressure on the trigger 260, a high degree of accuracy may be imposed, such that the weapon 200 must be in a very small offset threshold. With increased pressure on the trigger 260, a lower level of accuracy may be acceptable and the fire-time synthesizer 100 may generate the trigger signal 199 to fire the weapon 200 with a larger offset threshold.

Many marksmen will likely resist giving full control of their weapon 200 to an electronic system, so the fire-time synthesizer 100 may include elements to augment the marksman's ability rather than take control from him. Thus, the fire-time synthesizer 100 permits the marksman to enable an automatic function if he chooses or, simply by applying more pressure to the trigger 260, to override the automatic function if he wishes to take manual control. By providing additional pressure on the trigger 260, the weapon 200 would fire in spite of the fire-time synthesizer 100, thereby, overriding the automatic mode.

Most weapons include a "military creep," which is a somewhat loose play in the initial pull-back of the trigger before significant resistance on the trigger is encountered. In some embodiments, this military creep may be the same as the distance of the trigger pull to the motion-estimation position 264. Thus, in the automatic mode, the marksman would lay the weapon 200 on a target and take up the pressure in the trigger 260. That small movement of the trigger 260 would activate the sensing mechanism by going to the motion-estimation state 284. As the marksman stabilizes the weapon 200, the fire-time synthesizer 100 would begin integrating motion patterns of the weapon 200 as is explained more fully below. As the pressure is increased on the trigger 260, the fire-enable state 286 is entered. In the fire-enable state 286, the sear 275 is held in position until the weapon 200 is pointed near the center of the motion pattern. When the weapon 200 nears the center of the motion pattern, the electronics would release the sear 275. Should the rifleman "jerk" the trigger 260, the change in the motion pattern would pull away from the center and firing would be overridden, allowing the rifleman to regain his composure and try again. Should the rifleman desire to get the round off anyway, he could just pull harder on the trigger 260, entering the override state 288. By pulling the trigger 260 to the override position 268, the weapon 200 will fire immediately. In the FIG. 6 embodiment, this override may be mechanical or electrical. For example, the override position 268 may be enough to rotate the sear 275, via the linkage 270, and release the hammer 278. Alternatively, the override position 268 may be sensed by the trigger interface 280 causing the fire-time synthesizer 100 to immediately generate the fire control signal 196 (FIG. 1) to the solenoid 290' to rotate the sear 275.

Those of ordinary skill in the art will recognize that FIGS. 5 and 6 illustrate one non-limiting example of a trigger interface 280 and a fire actuator 290 in the form of solenoid 290'. As another non-limiting example, the trigger interface 280 may include a combination of displacement sensors 284, 286, and 288 as illustrated in FIG. 6, along with "force" sensors for detecting variations of pressure on the trigger 260. In other embodiments, the triggering mechanism may be electronic without a mechanical linkage 270 between the trigger 260 and the fire actuator 290 in the form of solenoid 290'. In still other embodiments, the trigger 260 may be electronic, such as, for example, buttons or knobs for the marksman to operate.

Figure 7:
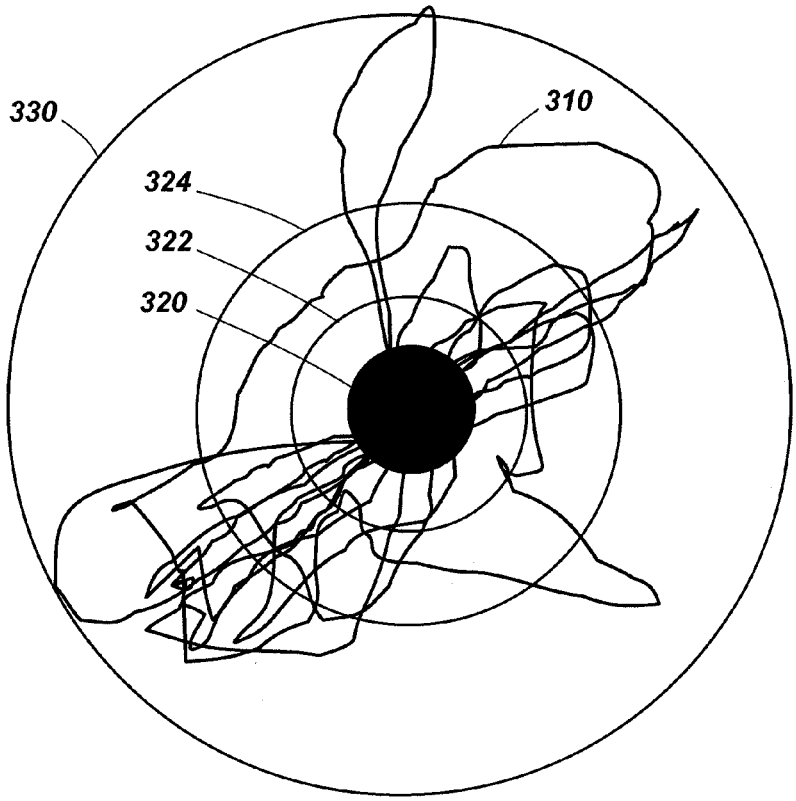
FIG. 7 illustrates a historical aiming pattern of a weapon.

FIG. 7 illustrates a historical aiming pattern of a weapon 200. Line 310 illustrates a motion pattern 310 that may be followed as the marksman attempts to hold the weapon 200 steadily aimed at a target. A centroid 320 indicates an average center area of the motion pattern 310. A range of motion 330 indicates the outer extents of the motion pattern 310. Offset thresholds (322, 324) indicate areas for which, if the motion pattern 310 is within these offset thresholds 322, 324, the fire-time synthesizer 100 may fire the weapon 200 (FIG. 1).

The motion pattern 310 will generally be somewhat random and somewhat periodic. A skilled marksman may be able to reduce much of the random motion. However, even with a skilled marksman there may be somewhat periodic motions caused by the marksman's heart rate or breathing pattern. Another source of somewhat periodic motion may be if the weapon 200 is mounted on a moving platform, such as a watercraft or aircraft. For example, there may be a periodic component in the motion pattern 310 due to wave movement for a ship, or blade rotation from a helicopter.

The motion-estimation algorithm may break the motion pattern 310 into an x-direction component and a y-direction component. Alternatively, the motion-estimation algorithm may use polar coordinates to indicate an angle and radial offset from the centroid 320.

Figure 8:
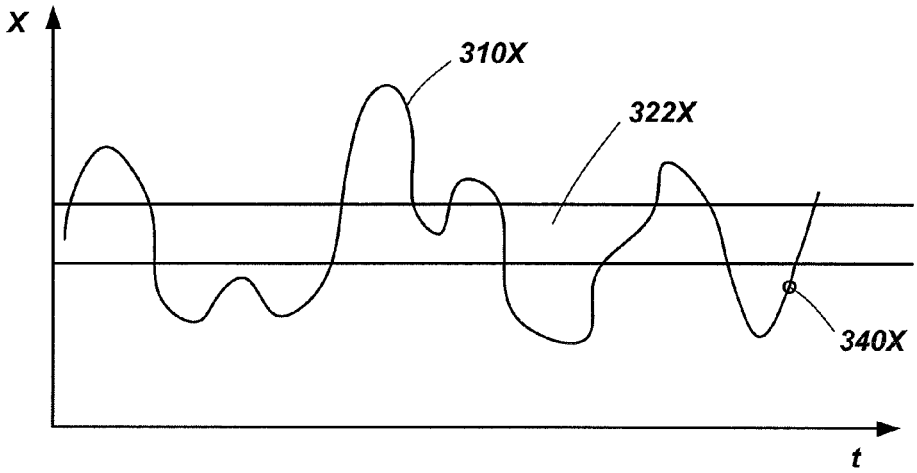
FIG. 8 is a graph illustrating a historical aiming pattern along an x-axis over a period of time.

FIG. 8 is a graph illustrating a historical aiming pattern along an x-axis over a period of time. With reference to both FIGS. 7 and 8, the motion pattern 310X illustrates the portion of the motion pattern 310 that is in the x-direction. X-offset threshold 322S illustrates an area for which, if the motion pattern 310X is within the X-offset threshold 322X, the fire-time synthesizer 100 may fire the weapon 200 (FIG. 1). Of course, while not illustrated, there will be a similar motion pattern for the y-direction.

Embodiments of the present invention act to create a synthetic weapon stabilization by firing the weapon 200 only when it is within a defined offset threshold (322, 324) from the centroid 320 or from the range of motion 330. Thus, with reference to FIGS. 1, 6, and 7, during the motion-estimation state 284, the fire-time synthesizer 100 collects a history of the motion pattern 310. With a motion pattern 310 established, the centroid 320 and range of motion 330 can be determined. During the fire-enable state 286, the fire-time synthesizer 100 will cause the weapon 200 to fire only when it is within a specified offset threshold (322, 324). This specified offset threshold 322, 324 may be user-selectable ahead of time, or may be defined by pressure on the trigger 260, as is explained above.

A longer history of motion may generate a more accurate centroid 320 and range of motion 330. Consequently, the length of the motion history and the offset threshold (322, 324) may be variables for the marksman to select based on the shooting situation. If the marksman is shooting at a relatively still target at long range, the marksman may select a relatively long motion history and a relatively narrow offset threshold (322, 324). On the other hand, if the marksman wants a quick response, is on a moving platform, or is tracking a moving target, the marksman may want to adjust for a wider offset threshold (322, 324), a shorter motion history, or combination thereof.

Most weapons 200 have a lock time, which is the time delay between when a trigger 260 is pulled and the projectile is launched. If the lock time is small, the above description of generating the fire control signal 196 when the motion pattern 310 is within the offset threshold (322, 324) will be adequate, because the aim of the weapon 200 may not change significantly between when the fire control signal 196 is asserted and the projectile launches.

Typical small arms have a lock time in the milliseconds. The lock time of a standard M16 is over 5 milliseconds, but aftermarket upgrades can reduce it to less than 5 milliseconds. Electronically ignited propellants may be substantially faster. In general, and not as a limitation, most lock times are in the 5 to 15 millisecond range. However, some weapons 200 may include piezoelectric, or other electronic, firing pins to reduce lock time even further. Such low-lock-time firing mechanisms could benefit significantly from embodiments of the invention.

If the lock time is large, or the track of the motion pattern 310 is changing rapidly, the aim of the weapon 200 may be outside the offset threshold (322, 324) by the time the projectile launches. Thus, in addition to determination of position from analysis of the motion pattern 310, the analysis may also determine a rate of change of the position for the motion pattern 310 (i.e., velocity in the form of speed and direction). If a velocity vector is determined, the fire-time synthesizer 100 may anticipate entry into the offset threshold (322, 324) at the lock time in the future. This anticipatory point is illustrated as 340X in FIG. 8. At a time $\Delta t$ in the future, the motion pattern 310X will enter the X-offset threshold 322X and approach the centroid 320 (FIG. 7). Thus, the fire-time synthesizer 100 could match $\Delta t$ to the lock time and generate the fire control signal 196 (FIG. 1) in anticipation of entering the X-offset threshold 322X or approaching the centroid 320. Of course, in a rectangular coordinate system, the fire-time synthesizer 100 would track both X and Y motion patterns. In a polar coordinate system, however, tracking only a radial velocity vector may be sufficient.

Tracking the motion pattern 310 may also include pattern recognition to recognize some of the periodic patterns that may be present. Recognizing these periodic patterns may assist in the anticipation algorithm by recognizing that the current motion and velocity vector may follow the path of a recognized pattern.

Figure 9A:
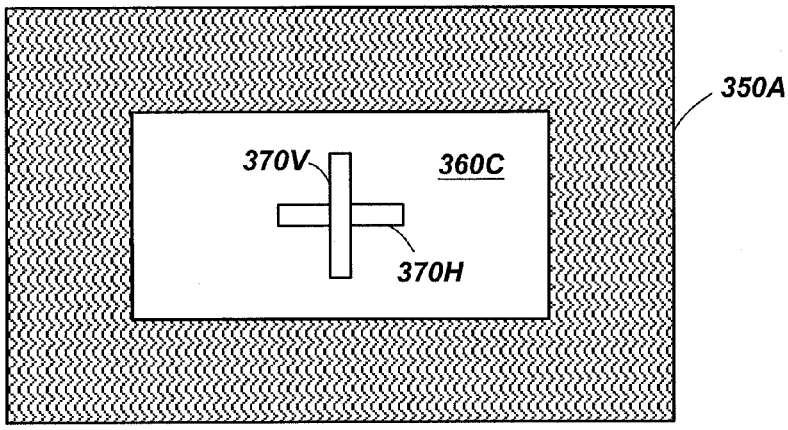
FIGS. 9A-9C illustrate image windows and possible active areas that may be used within the image windows according to an embodiment of the invention.
Figure 9B:
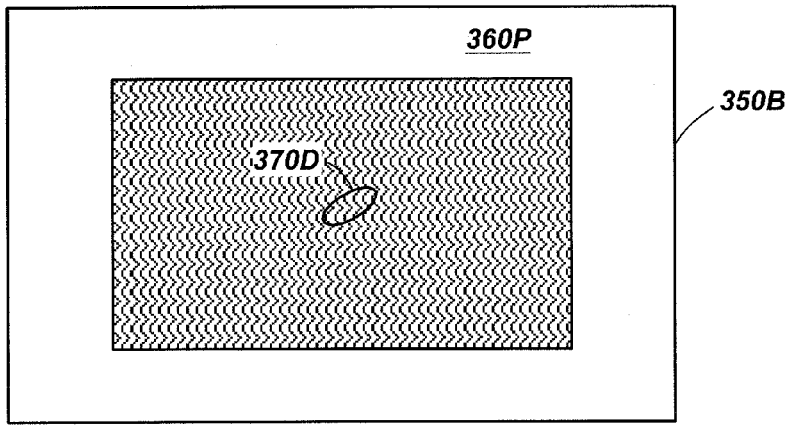
Figure 9C:
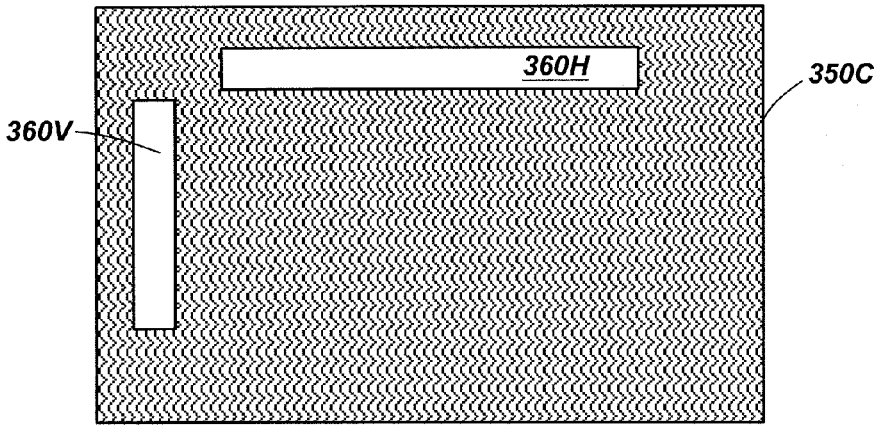

FIGS. 9A-9C illustrate image windows with active areas usable for determining motion estimation. In performing the motion analysis, the entire image window may be used or a smaller portion defined as an active area may be used. In FIG. 9A, a center active area 360C of the image window 350A is illustrated with the center active area 360C being substantially near the center of the image window 350A. The size of the center active area 360C may be adjusted as well as the position relative to the center of the image window 350A. In FIG. 9B, a peripheral active area 360P of the image window 350B is illustrated with the peripheral active area 360P being substantially near the periphery of the image window 350B. In FIG. 9C, rectangular active areas represented by a horizontal active area 360H and a vertical active area 360V of the image window 350C are illustrated with the active areas 360H and 360V being substantially near the periphery of the image window 350C. The size and placement of each of the active area configurations may be variable depending on a number of circumstances. The choice of active area configuration, size, and placement may be related to different shooting circumstances, different motion-estimation algorithms, anticipated background images, anticipated target images, and combinations thereof.

For example, if the marksman is shooting at a target that has significant intrinsic movement, but is at a relatively stationary position relative to the background, the peripheral active area 360P may be useful. By using the peripheral active area 360P in such a situation, only the motion of the relatively stable background is considered and any motion due to the target having moving parts can be ignored. On the other hand, if the target has little intrinsic motion, but is moving through the background, the center active area 360C may be more useful to only track background motion near the target and not have to consider motion of image area taken up by the target.

The horizontal active area 360H and vertical active area 360V may be useful in motion-estimation algorithms that determine the motion in terms of rectangular coordinates. Thus, the horizontal active area 360H may be used to determine mostly horizontal motion and the vertical active area 360V may be used to determine mostly vertical motion.

In addition, since the fire-time synthesizer 100 is only sensing relative motion, it can accomplish its task from any image features it can identify. Thus, it is not necessary for the direction of the image sensor 120 (FIG. 2) to be aligned with optical sighting elements of the weapon 200 (FIG. 1). In fact, the fire-time synthesizer 100 may be pointed in a direction substantially different from the direction the barrel is pointed.

FIG. 9A also illustrates a horizontal rectangular offset threshold 370H and a vertical rectangular offset threshold 370V. The offset thresholds may be many different shapes, such as square, circular, rectangular, and elliptical. In addition, the shapes may be oriented in different directions. FIG. 9B illustrates an elliptical offset threshold 370D oriented on a diagonal. Note that this elliptical offset threshold 370D would encompass a large amount of the periodic motion of the motion pattern 310 illustrated in FIG. 7. Thus, when using the elliptical offset threshold 370D most periodic motion may keep the motion pattern 310 within the threshold and only other random motion may extend the motion pattern 310 beyond the threshold.

A number of factors can be considered in performance of the fire-time synthesizer 100. It may be useful for the optical elements 115 (FIG. 2) to include high magnification to enhance sensitivity to relative motion. Furthermore, the field of view need only be slightly larger than the anticipated range of motion 330 (FIG. 7). A higher frame rate may be useful to achieve more motion estimation in a given time frame and more precision to the motion estimation. As stated earlier, a longer motion-estimation time will enable more accurate analysis of the centroid 320 and periodic movements. The optical magnification, field of view, sensor pixel count, active area, time in the motion-estimation state, and sensor frame rate are all engineering variables that can be tailored for specific application requirements.

Some embodiments may include compensation for only the trigger control and not wobble. In these embodiments, it may not be necessary to include an image element 110 (FIG. 2) or motion estimation. Enhanced accuracy may be achieved simply by providing a new and different trigger control. As stated earlier, the accuracy of a shot may be affected by the marksman flinching in anticipation of the recoil and jerking from an uneven pull on the trigger 260. Both of these inaccuracies can be alleviated somewhat by essentially "surprising" the marksman as to when the projectile will fire. If the marksman pulls the trigger 260 to the fire-enable position 266 (FIG. 6), but is not certain exactly when thereafter the projectile will fire, the marksman may not flinch in anticipation of the recoil. In addition, the firing occurs at a time delay after the trigger 260 is in the fire-enable position 266, at a time when the weapon 200 is not affected by a change in position of the trigger 260 or a change of pressure on the trigger 260. Thus, accuracy may be improved by the fire-time synthesizer 100 simply by providing a substantially random time delay for asserting the fire control signal 196 (FIG. 1) after entering the fire-enable state 286. Of course, while the random time delay may be large, it may only need to be in the millisecond range to be effective. In addition, the range of time delay may be a variable that could be under user control.

Figure 10:
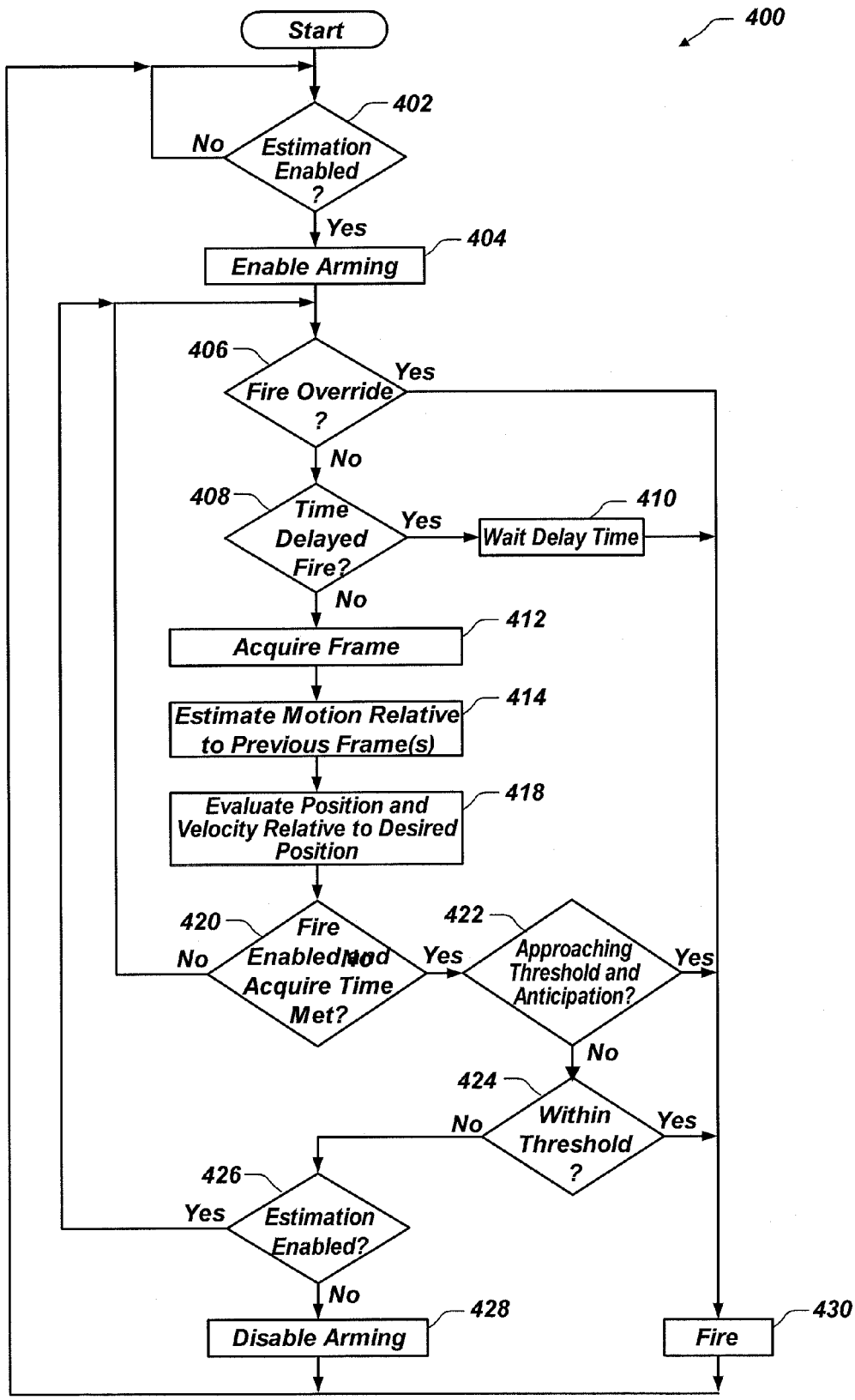
FIG. 10 is a simplified flowchart illustrating a process of synthetic weapon stabilization according to one or more embodiments of the invention.
Figure 10:
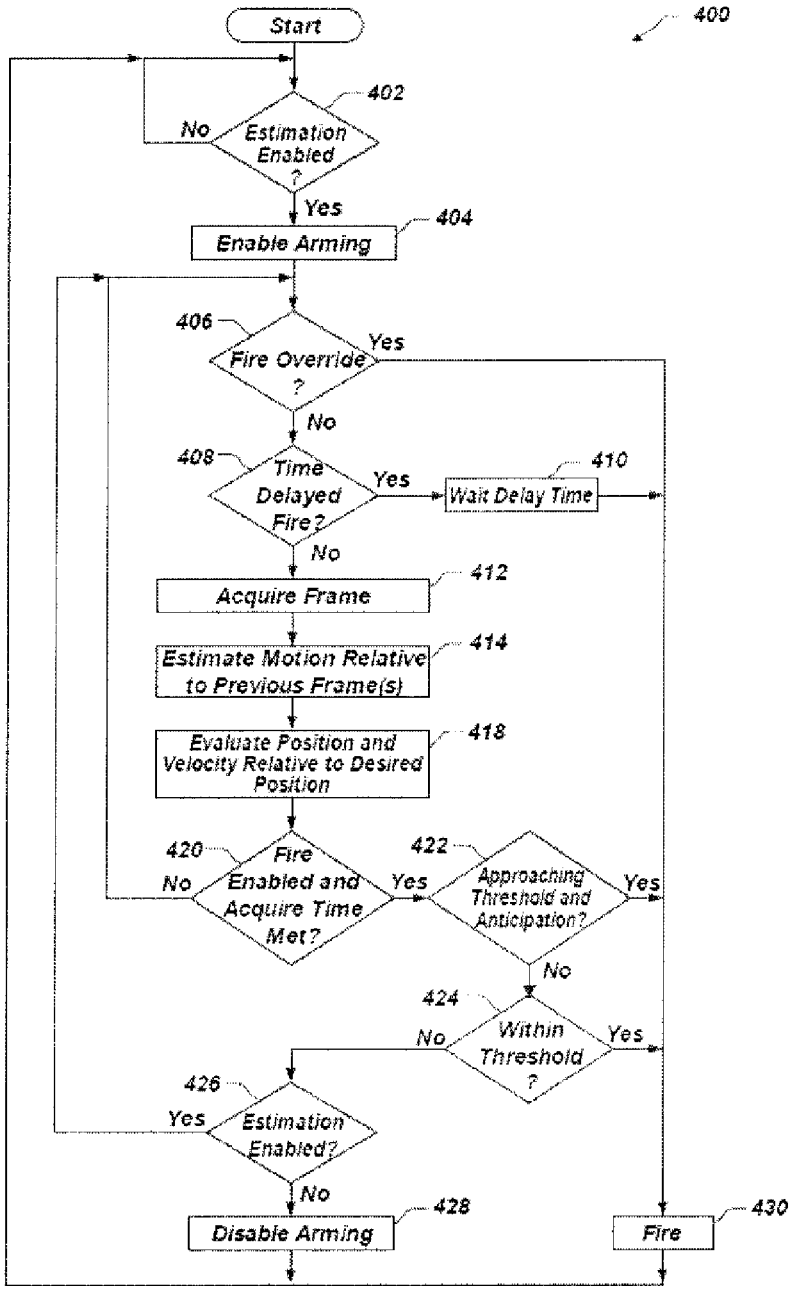

FIG. 10 is a simplified flowchart illustrating a process 400 of synthetic weapon stabilization according to one or more embodiments of the invention. When discussing the process of FIG. 10, reference is also made to the various firing and trigger states illustrated in FIG. 6, and the fire-time synthesizer 100 and the fire controller 180, both illustrated in FIG. 1. To start, decision block 402 tests to see if motion estimation is enabled. In other words, is the motion-estimation state 284 active? If not, the process 400 is essentially inactive and loops until the motion-estimation state 284 is active. If the motion-estimation state 284 is active, operation block 404 enables arming. This would start the motion-estimation process and enable the fire controller 180.

Decision block 406 tests to see if the override state 288 is active. If so, the process 400 should fire as soon as possible. Thus, the process 400 transitions directly to operation block 430 to assert the fire control signal 196 and fire the weapon 200. As explained earlier, in some embodiments the override may be mechanical, in which case, the fire control signal 196 may be redundant.

If the override state 288 is not active, decision block 408 tests to see if a time-delayed firing is enabled. In a time-delayed firing, motion estimation may not be used and operation block 410 waits for a substantially random time period. After the delay time, operation block 430 asserts the fire control signal 196.

If time-delayed firing is not enabled, operation block 412 acquires a new video frame from the image sensor 120 (FIG. 2). Operation block 414 performs the motion estimation on the current image position relative to one or more previous image frames. Operation block 418 then evaluates the current position and, if needed, the current velocity vector, and stores these values in a motion-estimation history. In general, past video frames beyond what is needed for the motion-estimation algorithm employed need not be saved. Only the motion-estimation values need to be used for historical motion analysis.

Decision block 420 tests to see if an acquire time has been met and the fire-enable state 286 is active. If not, control returns to decision block 406 to begin a new motion-estimation frame. The acquire time may be a user-defined variable to indicate a minimum amount of time to allow the motion-estimation algorithms to obtain a useful history for analyzing motion patterns 310, determining the centroid 320, determining the range of motion 330 (FIG. 7), and determining periodic movements.

If the acquire time has been met, and the fire-enable state 286 is active, decision block 422 tests to see if the process 400 is using an anticipation algorithm and the velocity vector indicates the motion pattern 310 is approaching the centroid 320 or the desired threshold. As stated earlier, the desired threshold may be user-selected, or may be a time-varying threshold dependent on the amount of pressure the marksman imposes on the trigger 260. Also, as stated earlier, the anticipation algorithm may be used to compensate for lock time and anticipate that the motion pattern 310 will be at a desired point at the end of the lock time. If the result of decision block 422 is yes, operation block 430 asserts the fire control signal 196.

If an anticipation algorithm is not being used, or the velocity vector is not appropriate for firing in anticipation of the lock time, decision block 424 tests to see if the current position of the motion pattern 310 is within a desired threshold. If so, operation block 430 asserts the fire control signal 196. Once again, the desired threshold may be user-selected, or may be a time-varying threshold dependent on the amount of pressure the marksman imposes on the trigger 260.

If decision block 424 evaluates false, decision block 426 tests to see that the motion-estimation state 284 is still active. If so, control returns to decision block 406 to begin a new motion-estimation frame. If the motion-estimation state 284 is no longer active, operation block 428 disables arming the weapon 200 as explained above with reference to FIG. 4 and the fire controller 180 of FIG. 1.

Embodiments of the invention may be adapted for rapid-fire applications, for example, weapons filing multiple projectiles or energy beams in bursts or over some other time period. As a non-limiting example, the fire-time synthesizer 100 could be set to fire subsequent rounds when the weapon 200 returns to its initial firing position or a pre-determined distance from the initial firing position. Thus, a very tight "spray" pattern or a very loose spray pattern may be selected depending on the circumstances.

Embodiments of the invention may be configured for removal, such that they can be used on multiple weapons 200. Thus, the fire-time synthesizer 100 may be removed from an unused weapon 200 and added to another weapon 200.

Returning to the user-interface module 140 of FIG. 1, as stated earlier, a number of variables may be defined for user control. As non-limiting examples, some of these user-controlled variables may be: selecting simple shot versus fully automatic optimizations; selecting a minimum motion-estimation time; selecting size, shape, and orientation of the offset threshold; and selecting lock time anticipation.

Although the present invention has been described with reference to particular embodiments, the present invention is not limited to these described embodiments. Rather, the present invention is limited only by the appended claims and their legal equivalents.

What is claimed is:

1. An apparatus for determining when to fire a weapon, comprising:

a motion detector configured for tracking motion of the weapon by analyzing relative motion of a barrel of the weapon;

a memory configured for storing computer instructions; and a processor operably coupled to the motion detector and the memory and configured for executing the computer instructions to:

determine a range of motion of the weapon over a time period of interest while the weapon is directed substantially toward a target, responsive to the tracking by the motion detector, and without an identification of a target by the apparatus; and generate a fire control signal responsive to a direction of the weapon being within an offset threshold of a centroid of tracked motion, the threshold being below the range of motion of the weapon.

2. The apparatus of claim 1, further comprising a trigger interface operable by a user and configured for determining a motion-estimation state to enable a period for determining the range of motion and a fire-enable state to enable the weapon to be fired; and wherein the processor is further configured for executing the computer instructions to generate the fire control signal at a substantially random time delay after the fire-enable state and independent from the act of determining the range of motion.

3. The apparatus of claim 1, further comprising an override apparatus configured for initiating discharge of the weapon responsive to an override state, wherein the override apparatus is selected from the group consisting of a mechanical override, an electrical override, and a combination thereof.

4. The apparatus of claim 1, further comprising a fire actuator configured for controlling discharge of the weapon responsive to the fire control signal.

5. The apparatus of claim 1, further comprising an analog motion sensor configured to determine at least one of a displacement history, a velocity history, and an acceleration history; and wherein at least one of the analog motion sensor and the processor is configured to:

determine the displacement history from the acceleration history if acceleration is detected or determine the displacement history from the velocity history if velocity is detected; and wherein the range of motion is determined responsive to the displacement history.

6. The apparatus of claim 1, wherein the offset threshold comprises a variable threshold selectable by a user.

7. The apparatus of claim 1, further comprising an image sensor configured for mounting on the weapon and for sensing a plurality of images over the time period of interest while the weapon is pointed at the target; and wherein the processor is further configured to:

determine a motion-estimation history over the time period of interest from changes in the plurality of images;

determine a centroid of the motion-estimation history; and generate the fire control signal when a current image is within the offset threshold from the centroid.

8. The apparatus of claim 7, wherein the processor is further configured for executing the computer instructions to generate the fire control signal when the current image is approaching the offset threshold responsive to an estimate of a time to enter the offset threshold relative to a time delay between generating the fire control signal and the weapon firing.

9. A method of determining a firing time for a weapon, comprising:

using a motion detector and a processor executing computer instructions stored in a memory to cooperatively perform the acts of:

tracking motion of the weapon by analyzing relative motion of a barrel of the weapon;

determining a range of motion of the weapon over a time period of interest while the weapon is directed substantially toward a target, responsive to the tracking, and without an identification of a target by the motion detector or the processor; and generating a fire control signal when a direction of the weapon is within an offset threshold of a centroid of tracked motion, the threshold being below the range of motion of the weapon.

10. The method of claim 9, further comprising using the motion detector and the processor executing the computer instructions stored in the memory for cooperatively generating the fire control signal responsive to an assertion of an override state.

11. The method of claim 9, further comprising using the motion detector and the processor executing the computer instructions stored in the memory for cooperatively selecting the offset threshold as a variable threshold selectable by a user.

12. The method of claim 9, wherein tracking motion of the weapon comprises:

sensing motion with an analog motion sensor to determine at least one of a displacement history, a velocity history, and an acceleration history;

if acceleration is detected, integrating the acceleration to determine a velocity history; and if velocity is detected or integrated, integrating the velocity to determine a displacement history;

wherein the range of motion is determined responsive to the displacement history.

13. The method of claim 9, wherein tracking motion of the weapon comprises analyzing a plurality of images from an image sensor affixed to the weapon over the time period of interest.

14. The method of claim 13, further comprising using the motion detector and the processor executing the computer instructions stored in the memory for cooperatively generating the fire control signal when an image of the plurality of images is approaching the offset threshold responsive to an estimate of a time to enter the offset threshold relative to a time delay between generating the fire control signal and the weapon firing.

15. A method of determining a firing time for a weapon, comprising:

using a motion detector and a processor executing computer instructions stored in a memory to cooperatively perform the acts of:

tracking motion of the weapon by analyzing relative motion of a barrel of the weapon;

determining a range of motion of the weapon over a time period of interest while the weapon is directed substantially toward a target, responsive to the tracking, and without an identification of a target by the motion detector or the processor;

sensing a plurality of images over the time period of interest with an image sensor fixedly coupled to the weapon while the weapon is pointed at the target;

processing the plurality of images to determine a motion-estimation history over the time period of interest responsive to changes in the plurality of images;

determining a centroid of the motion-estimation history; and generating a fire control signal when a direction of the weapon is within an offset threshold of the centroid of the motion-estimation history, the threshold being below the range of motion of the weapon and responsive to a current image position being within the offset threshold from the centroid.

16. The method of claim 15, further comprising using the motion detector and the processor executing the computer instructions stored in the memory for cooperatively generating the fire control signal responsive to an assertion of an override state.

17. The method of claim 15, further comprising using the motion detector and the processor executing the computer instructions stored in the memory for cooperatively generating the fire control signal when the current image position is approaching the offset threshold responsive to an estimate of a time to enter the offset threshold relative to a time delay between generating the fire control signal and the weapon firing.

18. The method of claim 15, further comprising using the motion detector and the processor executing the computer instructions stored in the memory for cooperatively selecting the offset threshold as a variable threshold selectable by a user.

19. The method of claim 15, further comprising using the motion detector and the processor executing the computer instructions stored in the memory for cooperatively pointing the image sensor in a direction other than at the target.

* * * * *

UNITED STATES PATENT AND TRADEMARK OFFICE

CERTIFICATE OF CORRECTION

PATENT NO. : 8,555,771 B2
APPLICATION NO. : 13/420441
DATED : October 15, 2013
INVENTOR(S) : William B. Kude It is certified that error appears in the above-identified patent and that said Letters Patent is hereby corrected as shown below:

On the title page:

In ITEM (56) References Cited:

U.S. PATENT DOCUMENTS

Page 1, 2nd column, line 8, change "Greene et" to --Greene et al.--

In the drawings:

In FIG. 10, Correct the text for reference numeral --420-- to --Fire Enabled and Acquire Time Met?--
Please replace Fig. 10 with the attached Fig. 10

Signed and Sealed this
Twenty-fourth Day of May, 2016

Michelle K. Lee

Michelle K. Lee
*Director of the United States Patent and Trademark Office*